US007326327B2

(12) United States Patent
Armstrong et al.

(10) Patent No.: US 7,326,327 B2
(45) Date of Patent: Feb. 5, 2008

(54) RHODIUM ELECTROPLATED STRUCTURES AND METHODS OF MAKING SAME

(75) Inventors: Michael Armstrong, Danville, CA (US); Gayle Herman, Danville, CA (US); Greg Omweg, Livermore, CA (US); Ravindra V. Shenoy, Dublin, CA (US)

(73) Assignee: FormFactor, Inc., Livermore, CA (US)

( * ) Notice: Subject to any disclaimer, the term of this patent is extended or adjusted under 35 U.S.C. 154(b) by 496 days.

(21) Appl. No.: 10/456,343

(22) Filed: Jun. 6, 2003

(65) Prior Publication Data

US 2004/0247920 A1 Dec. 9, 2004

(51) Int. Cl.
*C25D 5/02* (2006.01)
*C25D 3/00* (2006.01)

(52) U.S. Cl. ..... 205/118; 205/261

(58) Field of Classification Search ..... 205/261, 205/118, 136; 427/282, 123; 106/1.28
See application file for complete search history.

(56) References Cited

U.S. PATENT DOCUMENTS 3,152,938 A * 10/1964 Osifchin et al. ..... 430/315
3,676,087 A * 7/1972 Fefferman ..... 428/630
5,923,637 A * 7/1999 Shimada et al. ..... 369/126
6,520,778 B1 * 2/2003 Eldridge et al. ..... 439/66
6,861,858 B2 * 3/2005 Chen et al. ..... 324/755

FOREIGN PATENT DOCUMENTS

JP 2000147003 A * 5/2000
SU 560927 A * 10/1977

OTHER PUBLICATIONS

Wiesner, "Some Experiences in Heavy Rhodium Plating", Proc. Am. Electroplaters' Soc. (no month, 1952), vol. 39, pp. 79-100. Abstract Only.*
Wiesner, "Some Experiences in Heavy Rhodium Plating", Proc. Am. Electroplaters' Soc. (no month, 1952), vol. 39, pp. 79-100.*

* cited by examiner

*Primary Examiner*—Edna Wong
(74) *Attorney, Agent, or Firm*—N. Kenneth Burraston

(57) ABSTRACT

A halide based stress reducing agent is added to the bath of a rhodium plating solution. The stress reducing agent reduces stress in the plated rhodium, increasing the thickness of the rhodium that can be plated without cracking. In addition, the stress reducing agent does not appreciably decrease the wear resistance or hardness of the plated rhodium.

15 Claims, 6 Drawing Sheets

RHODIUM ELECTROPLATED STRUCTURES AND METHODS OF MAKING SAME

1. FIELD OF THE INVENTION

This invention relates generally to a method of plating rhodium and to rhodium plated structures.

2. BACKGROUND

Electrodeposition of rhodium (i.e., plated rhodium) has many uses. For example, rhodium is sometimes plated onto jewelry and other decorative items because of its attractive finish. As another example, because of its hardness and resistance to wear, rhodium is sometimes plated onto the wearing surfaces of various tools.

A long known disadvantage to plated rhodium, however, is its inherent high tensile stress. Because of the high tensile stress, plated rhodium often cracks. When plated onto jewelry or decorative items, the thickness of the plated rhodium is typically very thin (e.g., no thicker than 2.5 microns) to avoid cracking. Although there are known methods of plating thicker rhodium (e.g., on the order of 10 to less than 100 microns) using stress reducers in the plating bath to reduce the likelihood that the plated rhodium will crack, the use of stress reducers typically results in plated rhodium that is less hard and less resistant to wear than rhodium plated without the use of stress reducers. In one aspect, the present invention allows for the creation of thicker plated rhodium without substantial cracking. In another aspect of the present invention, the hardness and resistance to wear of the plated rhodium is not significantly diminished.

SUMMARY OF THE INVENTION

This invention relates generally to a method of direct current (DC) plating rhodium and to rhodium plated structures. In an exemplary embodiment of the invention, a chloride stress reducing agent is added to the plating bath. The stress reducing agent reduces stress in the plated rhodium, increasing the thickness of the rhodium that can be plated without cracking.

DETAILED DESCRIPTION OF EMBODIMENTS OF THE INVENTION

The present invention relates generally to a method of plating rhodium and to rhodium plated structures. This specification describes exemplary embodiments and applications of the invention. The invention, however, is not limited to these exemplary embodiments and applications or to the manner in which the exemplary embodiments and applications operate or are described herein.

Figure 1:
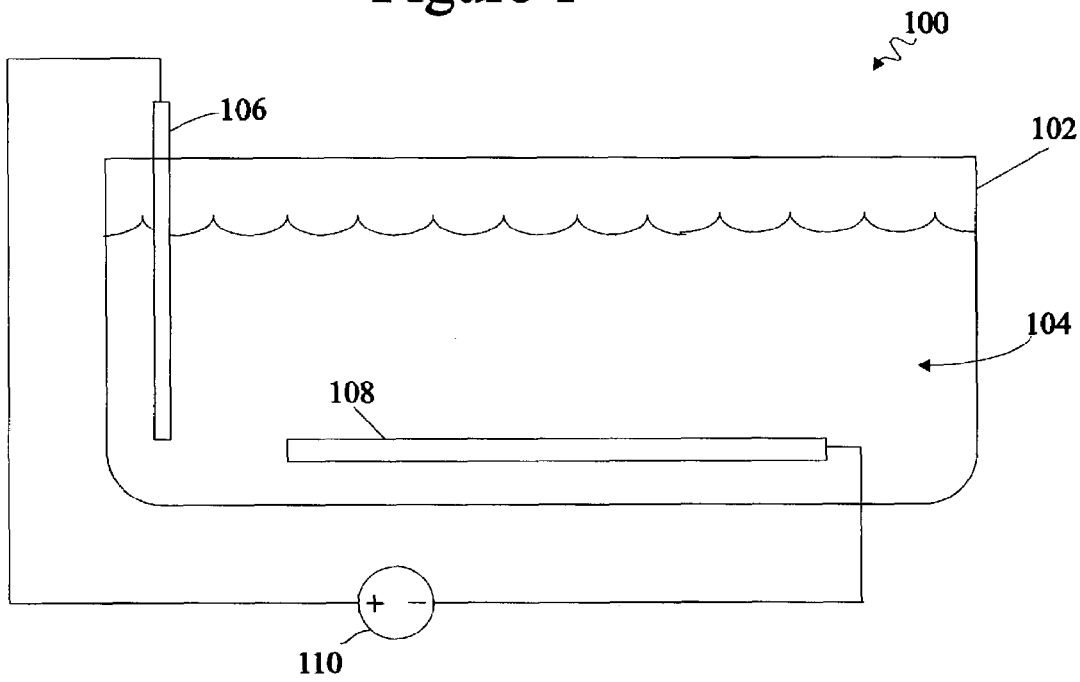
FIG. 1 illustrates a plating bath.

FIG. 1 shows a block diagram of basic parts of an exemplary plating bath. As shown, a tank 102 holds a plating solution 104. An anode 106 and a cathode 108 are immersed in the tank 102. A power source 110 is connected to the anode 106 and the cathode 108. As is known, the cathode 108 is plated as positively charged metallic ions in the plating solution 104 deposit on the negatively charged cathode 108.

The plating solution 104 preferably includes (but is not limited to) three basic ingredients: a rhodium solution, a conductivity enhancing solution, and a stress reducing agent. The rhodium solution provides rhodium ions, which will be plated onto the cathode. An aqueous solution containing 5-15 grams of rhodium per liter of solution is a nonlimiting example of a suitable rhodium solution. The conductivity enhancing solution ensures that the plating solution is electrically conductive. One nonlimiting example is sulfuric acid ($H_2SO_4$) in a concentration of 30-90 milliliters of sulfuric acid per liter of solution.

The third ingredient—the stress reducing agent—reduces stress in the plated rhodium and thus reduces the likelihood of cracking of the plated rhodium. The stress reducing agent contains a halide, which substantially reduces cracking in plated rhodium and thus substantially increases the thickness at which rhodium may be plated without cracking. It has also been found that the use of a halide as a stress reducing agent does not significantly reduce—and may not reduce at all—the hardness or resistance to wear of the plated rhodium. A nonlimiting example of a halide that may be used in a stress reducing agent is chloride. One example of a chloride stress reducing agent is a solution of hydrochloric acid (HCl) with a concentration of 10 ppm (parts per million) or greater. Generally speaking, the greater the concentration of chloride in the stress reducing agent, the thicker the rhodium that can be plated and remain substantially crack free. (A structure is substantially crack free if the structure is sufficiently free of cracks to function for its intended purpose.)

Figure 2:
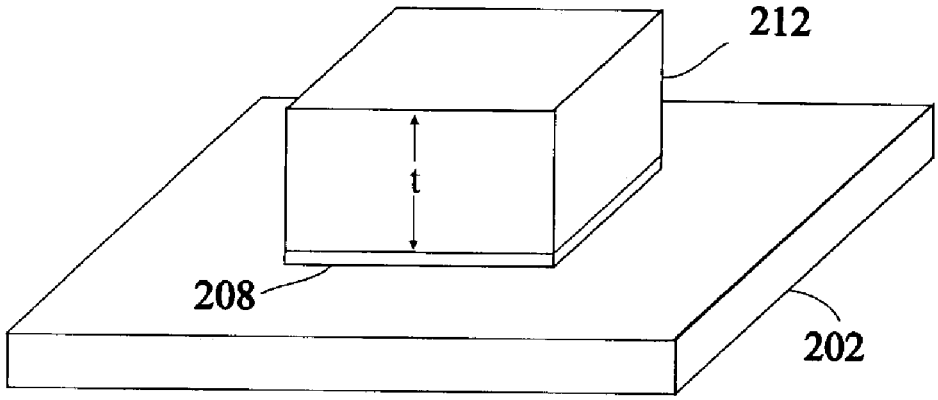
FIG. 2 illustrates a structure built up of plated rhodium.

FIG. 2 shows a support structure 202 with an electrically conductive terminal 208 and a mechanism (not shown) for providing an electrical connection from the terminal 208 to a power source, such as power source 110. Thus, while placed in a plating solution such as plating solution 104, terminal 208 acts as a cathode.

FIG. 2 also shows a rhodium structure 212 plated onto terminal 208. Using a plating solution, such as the one described above, such a rhodium structure 212 may be plated crack free in thicknesses "t" of 500 microns, 2500 microns, or thicker. Indeed, on a terminal 208 with an area of about 6.5 square centimeters, the inventors have plated crack free rhodium with a thickness "t" of 2500 microns using an exemplary plating bath including: a rhodium solution with a concentration of 11 g/L as a rhodium solution, sulfuric acid in a concentration of 60 ml/L as a conductivity enhancing solution, and hydrochloric acid in a concentration of 3000 ppm as a stress reducing agent. In the foregoing example, the inventors utilized a current flow from the power source 110 of about 8-1-amps per square foot. With a stress reducing agent having a concentration of 30 ppm hydrochloric acid, the inventors have plated rhodium to a thickness "t" of 500 microns without cracking. Generally speaking, the thickness of the plated rhodium that the inventors have plated without cracking has been generally proportional to the chloride concentration in the stress reducing agent of the plating solution.

It should be noted that the exemplary rhodium structure 212 shown in FIG. 2 is itself a stand alone structure. That is, the rhodium in the structure 212 is not merely a plating on a preexisting structure; rather, the structure 212 is built up entirely of plated rhodium. Thus, although the present invention may be used to plate rhodium onto a preexisting structure to a thickness not previously attainable, the present invention may also be used to create a structure or a portion of a structure that is made entirely of plated rhodium.

Figure 3:
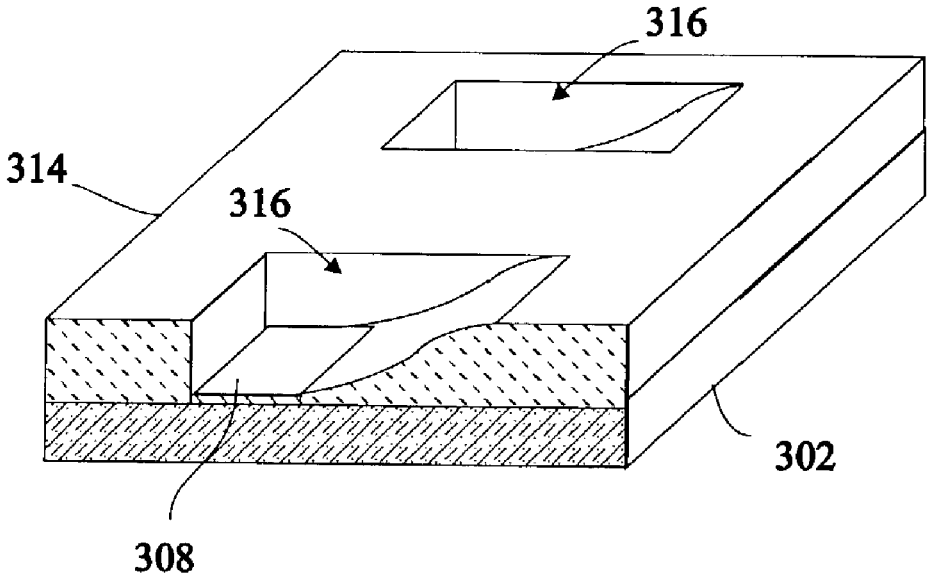
FIG. 3 illustrates a perspective, side cross-sectional view of an electronic component and photo resist with patterned openings in which contact structures are to be formed by plating rhodium.

FIGS. 3 and 4A-4C illustrate one exemplary application of a rhodium plating process in which electrical contact structures are formed on the terminals of an electronic component. FIG. 3 illustrates a perspective, cross-sectional view of an electronic component 302 that includes terminals 308 through which electrical connections are made with other electronic components (not shown). The electronic component 302 may be any type of electronic component, including without limitation an integrated circuit, a semiconductor die or wafer, a printed circuit board, a probing device, etc. As also shown in FIG. 3, a photo resist 314 or other patternable material is disposed on the electronic component 302. The photo resist 314 has been patterned to define openings 316 that expose the terminals 308 and, as will be seen, define the shape of the contact structures to be formed on the terminals. U.S. patent application Ser. No. 09/364,788 (filed Jul. 30, 1999) and U.S. Patent Application Publication No. 2001-0044225-A1, now U.S. Pat. No. 6,939,474 describe exemplary methods of forming and patterning photo resist on an electronic component; each of those patents is incorporated herein by reference in its entirety.

Figure 4A:
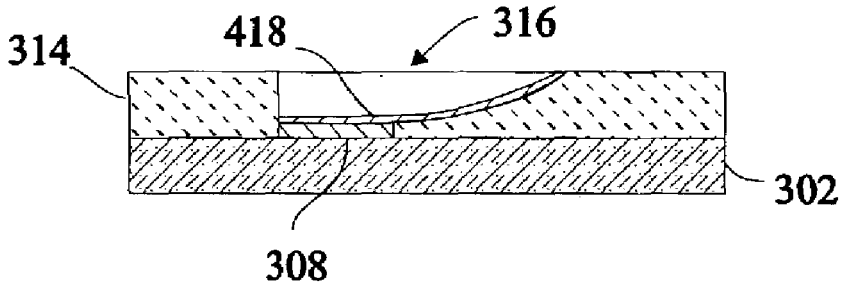
FIGS. 4A-4C illustrate side cross-sectional views of exemplary steps in a process of forming an electric contact structure of plated rhodium on the electronic component of FIG. 3.
Figure 4B:
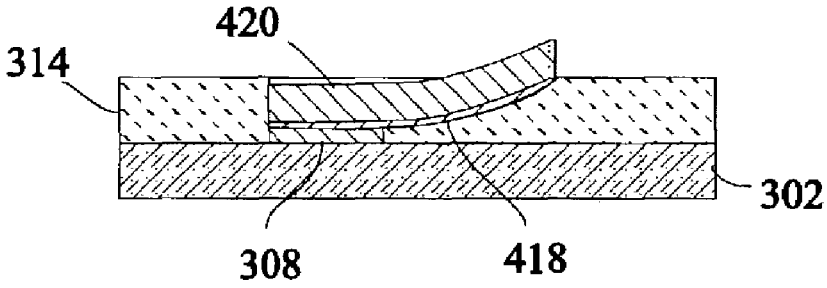
Figure 4C:
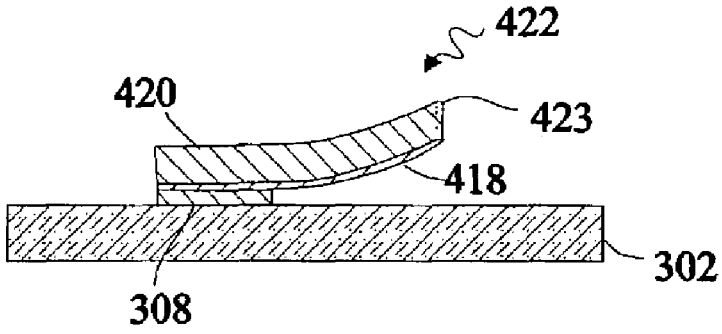

FIGS. 4A-4C show side, cross-sectional views of the electronic component 302 as the contact structure 422 is formed on terminal 308. As shown in FIG. 4A, a thin seed layer 418 is formed in the openings. The seed layer 418 may be any electrically conductive material and may be deposited in any suitable manner, such as by sputtering. Nonlimiting examples of suitable materials include copper, palladium, titanium, tungsten, silver, and their alloys.

The electronic component 302 is then placed in the plating solution 104 (see FIG. 1), and the seed layers 418 are connected to the power source 110 such that the seed layers act as the cathode. An electrical connection mechanism (not shown) connects the seed layers 418 to the power source 110 in the plating bath shown in FIG. 1. One exemplary method of providing an electrical connection from the seed layers 418 to the power source involves depositing a conductive, blanket layer (not shown) over the electronic component 302 before applying the photo resist 314. This electrically connects all of the terminals 308, which results in all of the seed layers 418 also being electrically connected. An electrical connection (not shown) is then provided from the blanket layer (not shown) to the power source 110. As shown in FIG. 4B, rhodium is then plated onto the seed layer, forming a rhodium structure 420.

Once the desired amount of rhodium has been plated onto the seed layer 418, the electronic component 302 is removed from the plating solution 104. As shown in FIG. 4C, the photo resist 314 is then removed, leaving rhodium contact structures 422 formed on the terminals 308 of the electronic component 302. If the blanket layer (not shown) discussed above was used to interconnect all of the terminals 308, exposed areas of the blanket layer (not shown) are also removed. Tip portions 423 of the rhodium contact structures 422 may be brought into contact with another electronic component (not shown), electrically connecting the electronic component 302 to the other electronic component (not shown).

Although not shown in FIGS. 4A-4C, one or more additional layers of materials may be formed on the rhodium contact structures 422. Of course, one or more additional layers of materials may be formed on the seed layer 418 prior to plating the rhodium. As another alternative, the contact structures 422 may be formed "upside down" on a sacrificial substrate (that is with the tip portion 423 formed on the sacrificial substrate) but otherwise generally as shown in FIGS. 4A-4C. The exposed ends of the contact structures 422 may then be attached to terminals of an electronic component (such as electronic component 302) and the contact structures 422 released from the sacrificial substrate. Examples showing formation of contact structures on a sacrificial substrate and their subsequent attachment to terminals of an electronic component are described in U.S. Pat. No. 6,482,013, which is incorporated herein by reference in its entirety.

Figure 5:
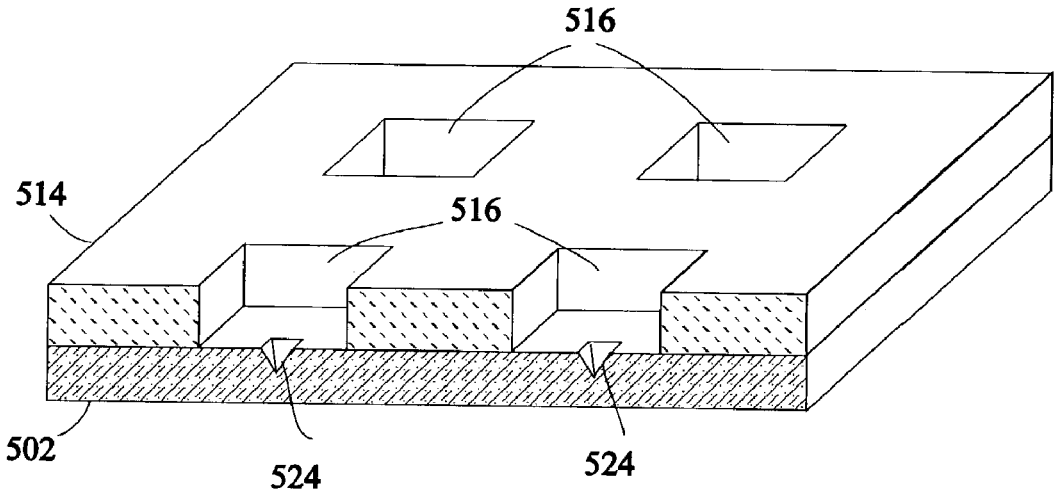
FIG. 5 illustrates a perspective, side cross-sectional view of a sacrificial substrate and photo resist with patterned openings in which tip structures are to be formed by plating rhodium.
Figure 6A:
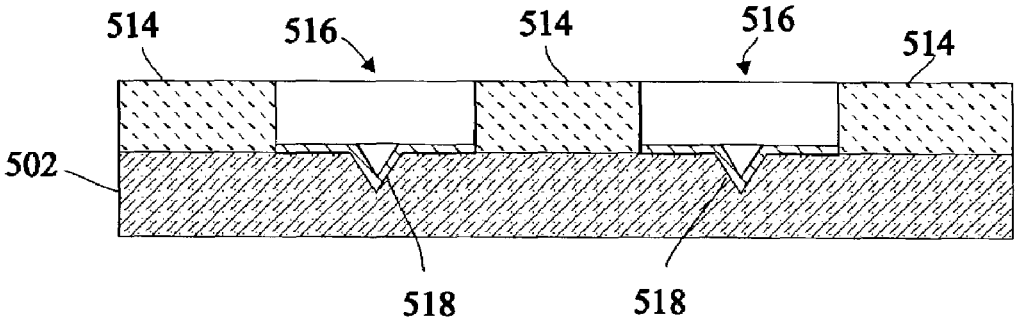
FIGS. 6A-6C illustrate side cross-sectional views of exemplary steps in a process of forming tip structures of plated rhodium on the sacrificial substrate of FIG. 5.
Figure 6B:
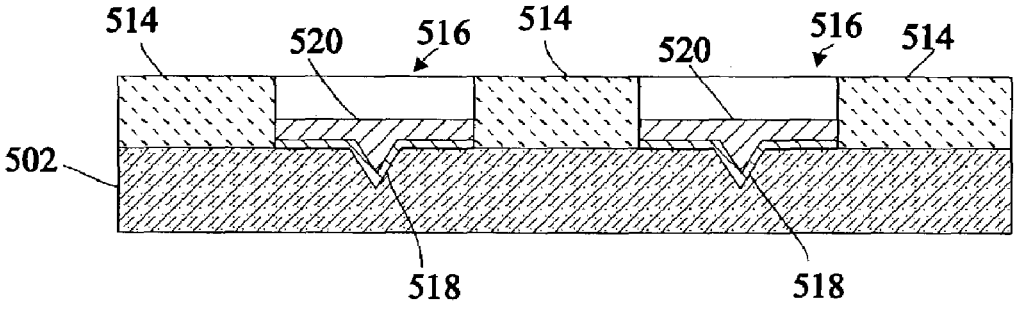
Figure 6C:
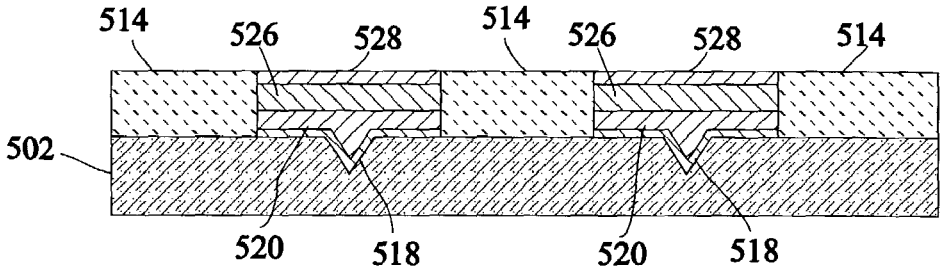
Figure 7:
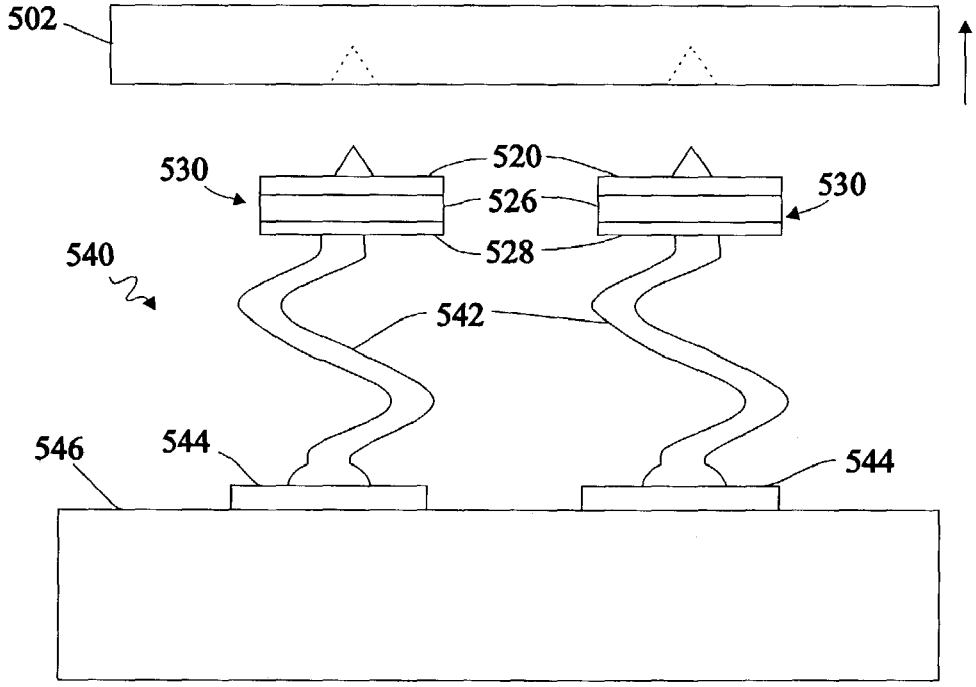
FIG. 7 illustrates transfer of the tip structures shown in FIG. 6C to probes on a probe head.

FIGS. 5, 6A-6C, and 7 illustrate another exemplary application of a rhodium plating process. In this example, tip structures 530 are formed of plated rhodium and are attached to probes 542 of a probing device 540 for probing another electronic device (not shown). (See FIG. 7.) As just one example, the probing device 540 may be a probe head of a probe card assembly for probing semiconductor wafers, such as the space transformer shown as element 506 in FIG. 5 of U.S. Pat. No. 5,974,662, which is incorporated herein by reference in its entirety. As illustrated in FIG. 7, probes 542 are attached to terminals 544 of a substrate 546 forming the probing device 540.

FIG. 5 illustrates a perspective, cross-sectional view of a sacrificial substrate 502, which may be, for example, a silicon wafer. As shown, a photo resist 514 or other patternable material is disposed over the surface of the sacrificial substrate 502. The photo resist 514 is patterned to have openings 516 that define the shape of the probe tips. The openings 516 also expose pits 524 etched into or otherwise formed in the sacrificial substrate 502.

FIGS. 6A-6C show side, cross-sectional views of the sacrificial substrate 502 as the tip structures 530 are formed. As shown in FIG. 6A, a thin seed layer 518 is formed in the openings 516 in the photo resist 514. Like the seed layers 418 described above with respect to FIG. 4A, seed layers 518 will function as the cathode in the plating bath 100 shown in FIG. 1. Thus, the seed layers 518 may be similar to the seed layers 418, as described above. In addition, seed layers 518 will act as a release material. That is, seed layers 518 are preferably readily etched or otherwise removed, releasing the tip structures 530 from the sacrificial substrate. Alternatively, separate seed and release layers may be deposited one on top of the other in openings 516.

The sacrificial substrate 502 is then placed in the plating solution 104 (see FIG. 1), and the seed layers 518 are connected to the power source 110 such that the seed layers act as the cathode. The seed layers 518 may be connected to the power source 110 as described above with respect to seed layers 418. Once the desired amount of rhodium 520 has been plated onto the seed layer 518 (see FIG. 6B), the sacrificial substrate 502 is removed from the plating solution 104. As shown in FIG. 6C, additional layers of materials may optionally be formed over the rhodium layer 520. In the example shown in FIG. 6C, a layer of nickel 526 is plated over the rhodium layer 520 followed by a layer of gold 528. The nickel 526 enhances the structural strength of the tip structure 530, and the gold layer 528 enhances subsequent attachment of the tip structures 530 to probes 542.

The photo resist 514 is then removed, and as shown in FIG. 7, the tip structures 530 are attached to probes 542 and then released from the sacrificial substrate 502. The tip structures 530 may be attached to the probes 542 in any suitable manner, including without limitation by soldering, brazing, or welding. The tip structures 530 are released from the sacrificial substrate 502 by etching or dissolving the seed layer 518. Probes 542 thus are provided with tip structures 530 that have a rhodium tip. Rhodium may be an advantageous tip material because of its superior hardness and wear properties, its high melting point and resulting resistance to damage caused by electrical arcing, and its high electrical conductivity.

Probes 542 may be any type of probe including without limitation needle probes, buckling beam probes, bump probes, or spring probes. Nonlimiting examples of spring probes are described in U.S. Pat. No. 5,917,707, U.S. Pat. No. 6,255,126, and U.S. Patent Application Publication No. 2001-0012739-A1, all of which are incorporated herein in their entirety by reference. As mentioned above, probing device 540 may be any device for probing an electronic component, including without limitation a probe card assembly for probing semiconductor wafers. Tip structures 530 may be formed in any desirable shape and size. Nonlimiting examples of various shaped tip structures are described in U.S. Pat. No. 6,441,315, which is incorporated herein by reference in its entirety. Indeed, more than tip structures may be formed using the process shown in FIGS. 5, 6A-6C, and 7. Probe beams and even entire probes may be formed and then transferred to posts or terminals on a probe head. Examples are shown in U.S. patent application Ser. No. 09/953,666 (filed Sep. 14, 2001) and U.S. Patent Application Publication No. 2001-0012739-A1, now U.S. Pat. No. 7,063,541 both of which are incorporated herein by reference in their entirety.

Although the principles of the present invention have been illustrated and explained in the context of specific embodiments, it will be appreciated by those having skill in the art that various modifications beyond those illustrated can be made to the disclosed embodiments without departing from the principles of the present invention.

What is claimed is:

1. A method of plating rhodium comprising:

placing a cathode in a rhodium plating bath, said bath comprising a halide-based stress reducing agent, said cathode comprising a seed layer formed in an opening in a patternable material disposed on a sacrificial substrate, the opening patterned to define a shape of a contact tip structure; and forming a rhodium contact structure by electroplating rhodium on said cathode seed layer in said opening, wherein at least a portion of said rhodium plated on said cathode extends at least 100 microns from said cathode.

2. The method of claim 1, wherein said stress reducing agent comprises chloride.

3. The method of claim 2, wherein said stress reducing agent comprises chloride in a concentration of at least 10 parts per million.

4. The method of claim 2, wherein said stress reducing agent comprises chloride in a concentration of at least 30 parts per million.

5. The method of claim 1, wherein at least a portion of said rhodium plated on said cathode extends at least 500 microns from said surface of said cathode.

6. The method of claim 1, wherein said rhodium plated on said cathode is substantially crack free.

7. The method of claim 1, wherein said rhodium plated on said cathode is substantially as wear resistant as rhodium plated from a plating bath without a stress reducing agent.

8. The method of claim 1, wherein said rhodium plated on said cathode is substantially as hard as rhodium plated from a plating bath without a stress reducing agent.

9. The method of claim 1, wherein at least a portion of said rhodium plated on said cathode extends at least 2500 microns from said surface of said cathode.

10. The method of claim 1 wherein said substrate comprises an electronic component.

11. The method of claim 1, wherein said rhodium contact structure comprises a contact portion of a tip structure.

12. The method of claim 11, wherein said tip structure further comprises materials other than rhodium.

13. The method of claim 11 further comprising securing said tip structure to a probe.

14. The method of claim 13, wherein said probe is disposed on a probe head.

15. The method of claim 13 further comprising releasing said tip structure from said sacrificial substrate.

* * * * *